US006922866B2

(12) United States Patent
Er

(10) Patent No.: US 6,922,866 B2
(45) Date of Patent: Aug. 2, 2005

(54) PAINT ROLLER

(76) Inventor: Poh Leong Er, 369 Joo Chiat Place, Singapore (SG), 428027

( * ) Notice: Subject to any disclaimer, the term of this patent is extended or adjusted under 35 U.S.C. 154(b) by 474 days.

(21) Appl. No.: 10/234,921

(22) Filed: Sep. 4, 2002

(65) Prior Publication Data

US 2004/0040111 A1 Mar. 4, 2004

(51) Int. Cl.[7] ..... B05C 17/02
(52) U.S. Cl. ..... 15/230.11; 492/13; 492/19
(58) Field of Search ..... 15/230.11; 492/13, 492/14, 16, 17, 19

(56) References Cited

U.S. PATENT DOCUMENTS 1,055,113 A * 3/1913 Wittrock ..... 305/60
3,588,264 A * 6/1971 Mallindine ..... 401/127
3,815,196 A * 6/1974 Gotham et al. ..... 193/37
6,036,392 A * 3/2000 Er ..... 401/197
6,098,240 A * 8/2000 Taylor ..... 15/230.11

* cited by examiner

*Primary Examiner*—Randall Chin

(57) ABSTRACT

A paint roller (10) has a paint applicator (12), two holder mounts an applicator holder (14). The paint applicator (12) has a cylindrical outer surface and two opposite ends (18*a*, 18*b*). The two holder mounts, respectively associated with the two opposite ends (18*a*, 18*b*), each has a base surface (24) and a journal (26) that protrudes from the surface (24) away from the paint applicator (12). The applicator holder (14) has a handle (40) and a fork (42) with opposite sides (44,48) that each has a journal engagement portion (48,50). In a preferred embodiment, each of the holder mounts has holder abutments, (30) that protrude from the surface (24) away from the paint applicator (12). In an alternate embodiment, the applicator holder (14) has applicator abutments that protrude from mount abutment surfaces of each of two journal engagement portions towards the paint applicator (12).

20 Claims, 3 Drawing Sheets

PAINT ROLLER

FIELD OF THE INVENTION

The present invention relates to apparatus for applying fluids over surfaces. In particular, the present invention relates to a paint roller for storing and applying paint.

BACKGROUND OF THE INVENTION

Paint rollers for applying paint onto surfaces are known. Typically, such paint rollers have paint-absorbing surfaces that are dipped into paint containers and then rolled over surfaces that are to be painted. For example, U.S. Pat. No. 6,098,240, issued to Taylor, describes a roller paint applicator with a cylindrical body and that is secured to an applicator holder for rotation around a spindle using an end cap. However, rotation of the paint roller described in U.S. Pat. No. 6,098,240 is a problem when excessive force is applied to the applicator holder. Such a force can dent the paint applicator towards the spindle and undesirably restrict rotation of the spindle.

Another type of paint roller is described in U.S. Pat. No. 6,098,240 in which internal storage or container space is provided to store paint. The paint is then transferred from the internal storage or container space through permeable members onto surfaces. An example of such an improvement to paint rollers is disclosed in U.S. Pat. No. 3,588,264, issued to Mallindine and that describes a container-type paint roller with a roller assembly. The roller assembly is rolled along a surface by means of a forked handle that is coupled to journals of end-closure members disposed at opposite ends of the roller assembly.

However, rotation of the roller assembly of U.S. Pat. No. 3,588,26 can be a problem as the end-closure members contacts the entire surface of sides of the forked handle. Consequently, frictional resistance between the sides and the end-closure members impedes the rotation of the roller assembly to some extent. Furthermore, any unevenness of the surface of the end closure members also impedes the rotation. Such unevenness is difficult to avoid or eliminate in mass production of the end-closure members or the forked handle.

Therefore, a need clearly exists for a container-type paint roller that enables easier rotation of a paint applicator by reducing frictional resistance between rotating elements. Such a container-type paint roller should have covers that secure tightly to the paint applicator or an applicator holder without, or at least alleviating, undesired dislodging of such covers during use.

BRIEF SUMMARY OF THE INVENTION

The present invention seeks to provide a paint roller having a paint applicator and two holder mounts that are respectively associated with two opposite ends of the paint applicator, and an applicator holder for the paint roller.

Accordingly, in one aspect, the present invention provides a paint roller comprising:

- a paint applicator having a cylindrical outer surface and two opposite ends; and
- two holder mounts, respectively associated with said two opposite ends, each of said holder mounts having:
  - a base surface;
  - a journal, protruding from said base surface in a direction away from said paint applicator; and
    - a plurality of holder abutments, protruding from said base surface in said direction.

In another aspect, the present invention provides a paint roller comprising:

- a paint applicator having a cylindrical outer surface and two opposite ends;
- two holder mounts, respectively associated with said two opposite ends, each of said holder mounts having:
  - a base surface;
  - and
  - a journal, protruding from said base surface in a direction away from said paint applicator;
  - and
- an applicator holder having:
  - a handle;
  - and
  - a fork having opposite sides, each of said opposite sides having:
    - a journal engagement portion;
    - and
    - a plurality of applicator abutments, protruding from a surface of said journal engagement portion in a direction towards said paint applicator.

In yet another aspect, the present invention provides an applicator holder for a paint roller with at least one journal, said applicator holder comprising:

- a handle;
- and
- a fork having opposite sides, each of said opposite sides having:
  - a journal engagement portion;
  - and
  - a plurality of applicator abutments, protruding from a surface of said journal engagement portion in a direction towards said at least one journal.

BRIEF DESCRIPTION OF THE DRAWINGS

A preferred embodiment and an alternate embodiment of the present invention are described, by way of example, with reference to the drawings of which.

DETAILED DESCRIPTION OF THE DRAWINGS

A paint roller comprising a paint applicator and two holder mounts for coupling to an applicator holder, and an applicator holder for the paint roller in accordance with a preferred embodiment and an alternate embodiment of the invention are described. In the following description, details are provided to describe these embodiments. However, it shall be apparent to one skilled in the art that the invention may be practiced without such details. Some of these details may not be described at length so as not to obscure the invention.

There are many advantages of the embodiments of the invention. One advantage of the embodiments is that frictional resistance between abutting surfaces of the holder mounts and the applicator holder is reduced. Consequently, the embodiments enable a more effective rotation of the paint applicator when held by the applicator holder during use of the paint roller.

Another advantage of the embodiments of the invention is that ridges, formed on an internal wall of a cylindrical protrusion of one of the holder mounts and on a cover, enable a tight capping of the holder mount. Consequently, paint is stored more securely within the paint applicator to prevent, or to at least alleviate, accidental spills due to dislodging of the cover during use of the paint roller.

Figure 1:
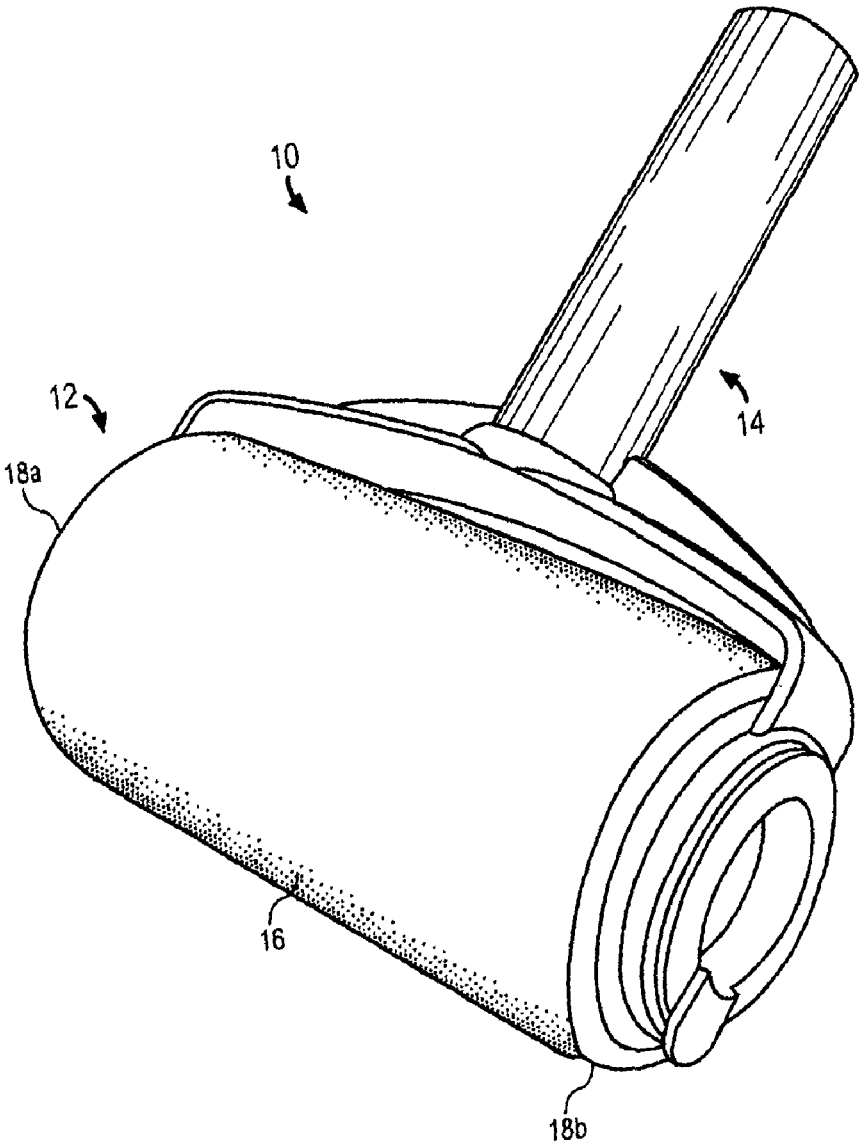
FIG. 1 is a perspective view of a paint roller having a paint applicator and an applicator holder in accordance with the preferred embodiment of the invention.

Referring now to FIG. 1, a perspective view of a paint roller 10 in accordance with the preferred embodiment of the invention is illustrated. The paint roller 10 comprises a paint applicator 12 and an applicator holder 14 for holding the paint applicator 12. The paint applicator 12 has a cylindrical outer surface 16 and two opposite ends 18*a*,18*b*. The paint applicator 12 is preferably made of a paint absorbent material such as, for example, foam or sponge.

Figure 2:
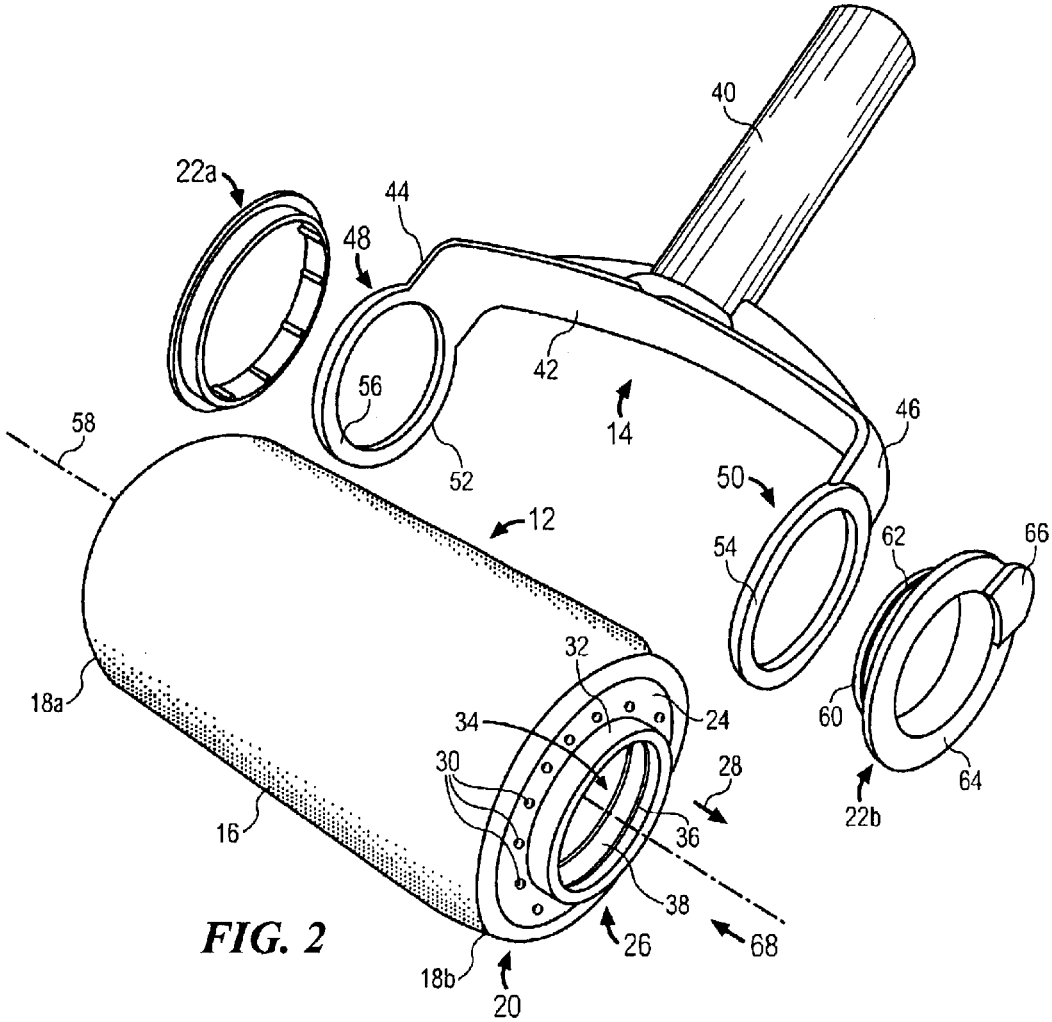
FIG. 2 is an exploded view of the paint roller of FIG. 1 in accordance with the preferred embodiment of the invention.

The paint roller 10 further comprises two holder mounts, respectively associated with the two opposite ends 18*a*,18*b*. A holder mount 20, associated, with the opposite end 18*b*, is shown in the exploded view of the paint roller 10 in FIG. 2. Also shown in FIG. 2 are two covers 22*a*,22*b* for respectively capping the two holder mounts.

The holder mount 20 has a base surface 24 and comprises a journal 26 that protrudes from the base surface 24 in a direction 28 away from the paint applicator 12. The holder mount 20 further has a plurality of holder abutments 30 protruding from the base surface 24 in the direction 28.

The journal 26 comprises a cylindrical protrusion 32 forming a channel 34 through which paint is channeled for storage within, or for removal from, a chamber (not shown) of the paint applicator 12. In this preferred embodiment of the invention, the plurality of holder abutments 30 surrounds the cylindrical protrusion 32. The cylindrical protrusion 32 has an internal wall 38 with a channel ridge 36 formed thereat.

The applicator holder 14 has a handle 40 and a fork 42 having opposite sides 44,46. Each of the opposite sides 44,46 has, respectively, a journal engagement portion 48,50. Each of the journal engagement portions 48,50 comprises, respectively, a loop 52,54. The loop 54 couples to the cylindrical protrusion 32 at the opposite end 18*b*, and the loop 52 couples to a cylindrical protrusion (not shown) at the opposite end 18*a*, to enable rotation of the paint applicator 12 during use. In coupling to the cylindrical protrusion 32, each loop 52,54 encircles the cylindrical protrusion 32 at each of the opposite ends 18*a*, 18*b*.

Each of the loops 52,54 has a mount abutment surface. A mount abutment surface 56 for the loop 52 is indicated. The mount abutment surface (not shown) for the loop 54 is similar to the mount abutment surface 56 for the loop 52.

The two covers 22*a*,22*b* are different because each serves a different function. The cover 22*a* couples to the mount holder (not shown) at the end 18*a* to retain the loop 52 and the cover 22*b* couples to the mount holder 20 to retain the loop 54. When thus coupled, the paint applicator 12 is rotatable about a rotary axis 58.

The cover 22*b* comprises a wall engagement portion 60 for engaging the internal wall 38. The wall engagement portion 60 has a cover ridge 62 for coacting with the channel ridge 36. The cover 22*b* further comprises a flange 64 extending beyond a perimeter of the wall engagement portion 60 and a flange extension 66. The flange extension 66 enables removal of the cover 22*b* to thereby replenish paint within, or empty paint from, the chamber of the paint applicator 12 via the channel 34.

The remaining journal (not shown) that is associated with the holder mount at the opposite end 18*a* does not have a channel. However, this remaining journal can be modified to have such a channel as the journal 26. Consequently, the cover 22*a* caps the journal (not shown) at the opposite end 18*a* to retain the loop 52 to the mount holder (not shown).

Coaction between the cover ridge 62 and the channel ridge 36 provides a snap fit that serves as an audible indication that the cover 22*b* has properly covered the opening of the channel 34. The coaction also enables a tight capping of the holder mount 20 by the cover 22*b*. Specifically, the diameter of the wall engagement portion 60 is made slightly larger than the diameter of the channel 34 to provide a secure fitting when capping the holder mount 20 with the cover 22*b*. Hence, a force applied to cap the cover 22*b* onto the holder mount 20 has to overcome abutting of the wall engagement portion 60 and the channel 34 as well as abutting of the cover ridge 62 and the channel ridge 36.

Figure 3:
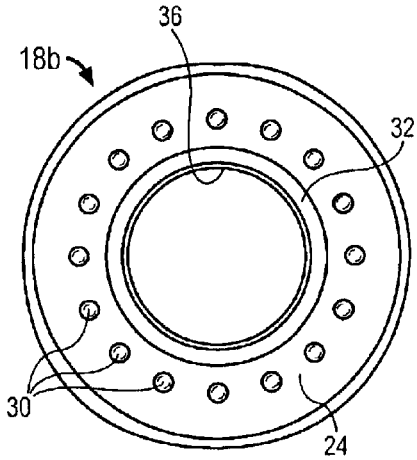
FIG. 3 is a plan view of a holder mount associated with one end of the paint applicator of the paint roller of FIG. 2.

FIG. 3 is a plan view of the holder mount 20 associated with the opposite end 18*b* of the paint applicator 16 and looking into the channel 34 in a direction 68.

Figure 4:
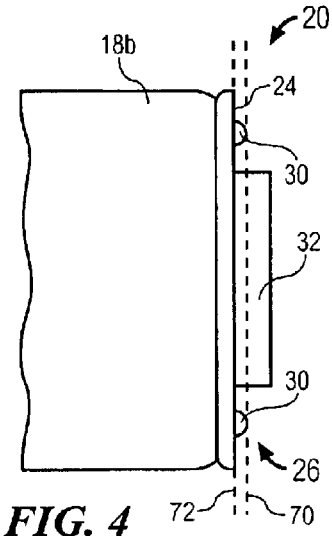
FIG. 4 is a side view of the holder mount of FIG. 3.

FIG. 4 is a side view of the holder mount 20 showing position of the plurality of holder abutments 30 relative to the base surface 24 and the cylindrical protrusion 32. The plurality of holder abutments 30 is substantially aligned to provide an abutment plane 70. In the preferred embodiment, the abutment plane 70 is planarly parallel to a base plane 72 provided by the base surface 24 and spaced apart by the thickness of each holder abutment 30.

As the mount abutment surfaces of the loops 52,54 only contact specific surface areas of the plurality of holder abutments 30 providing the abutment plane 70, frictional resistance between the mount holders at both ends 18*a*, 18*b* and the loops 52,54 is reduced. Consequently, rotation of the paint applicator 12 when held by the applicator holder 14 is easier compared with existing container-type paint rollers.

In the preferred embodiment as shown in FIG. 2, FIG. 3 and FIG. 4, each of the plurality of holder abutments 30 is hemispherical. However, it is to be noted that other shapes are also possible for the plurality of holder abutments 30 to reduce contact areas and, hence, reduce frictional resistance between the two holder mounts of the paint roller 10 and the loops 52,54. For example, each of the plurality of holder abutments 30 can have a flat surface that, collectively, are substantially aligned along the flat surface relative to each other to thereby provide the abutment plane 70. Otherwise, in the absence of the plurality of holder abutments 30, there would be full surface contact between the base surface 24 and the mount abutment surfaces of the loops 52,54, which results in more frictional resistance.

Figure 5:
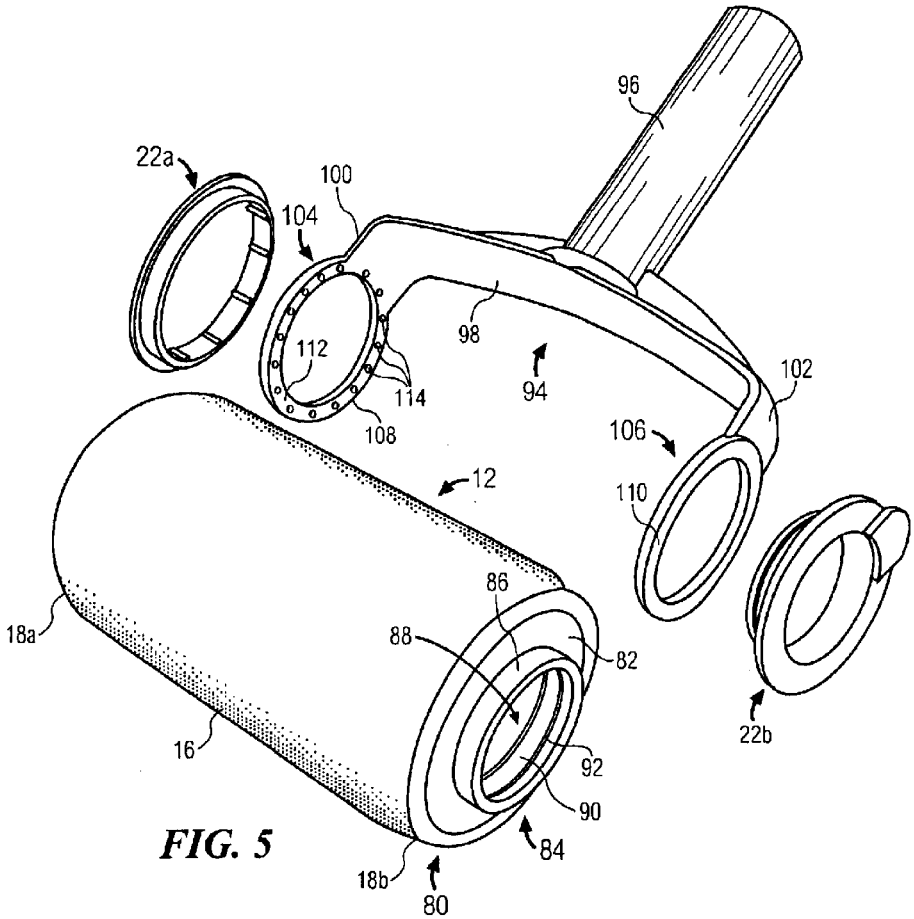
FIG. 5 is an exploded view of the paint roller of FIG. 1 in accordance with the alternate embodiment of the invention.

Referring now to FIG. 5, an exploded view of the paint roller 10 in accordance with the alternate embodiment of the invention is illustrated. For the alternate embodiment, the paint roller 10 comprises two holder mounts at each of the two opposite ends 18*a*, 18*b* of the paint applicator 12. As shown in FIG. 5, a holder mount 80 for the end 18*b* comprises a base surface 82 and a journal 84.

As in the preferred embodiment, the journal 84 comprises a cylindrical protrusion 86 that extends from the base surface 82 and forms a channel 88 through which paint is channeled for storage within the paint applicator 12 or removal therefrom. The cylindrical protrusion 86 has an internal wall 90 with a channel ridge 92 formed thereat.

An applicator holder 94 for the alternate embodiment of the paint roller 10 has a handle 96 and a fork 98 having opposite sides 100,102. Each of the opposite sides 100,102 has, respectively, a journal engagement portion 104,106. Each of the journal engagement portions 104,106 comprises, respectively, a loop 108,110. The loop 110 couples to the cylindrical protrusion 86 at the opposite end 18*b*, and the loop 108 couples to a cylindrical protrusion (not shown) at the opposite end 18*a*, to enable rotation of the paint applicator 12 during use.

Each of the journal engagement portions 104,106 has a mount abutment surface. A mount abutment surface 112 for the loop 108 is indicated. Protruding out from the mount abutment surface 112 in a direction towards the paint applicator 12 are a plurality of applicator abutments 114. The mount abutment surface (not shown) for the loop 110 also has a plurality of applicator abutments (not shown).

The two covers 22*a*,22*b* for this alternate embodiment function similarly as in the preferred embodiment. Hence, in the alternate embodiment, respective features of each of these two covers 22*a*,22*b* coact with respective features of the mount holders of the alternate embodiment.

Figure 6:
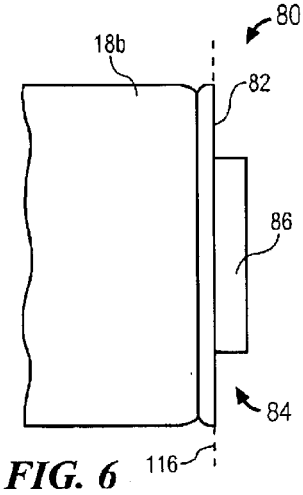
FIG. 6 is a side view of a holder mount associated with one end of the paint applicator of the paint roller of FIG. 5.

FIG. 6 is a side view of the holder mount 80 in which a holder abutment plane 116 formed by the base surface 82 is indicated.

Figure 7:
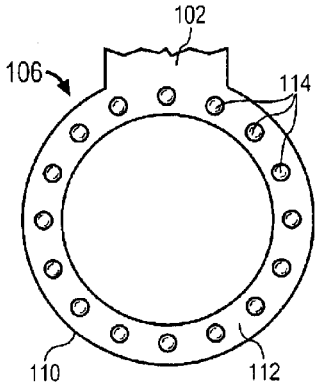
FIG. 7 is a plan view of a journal engagement portion of an applicator holder for the paint roller of FIG. 5.
Figure 8:
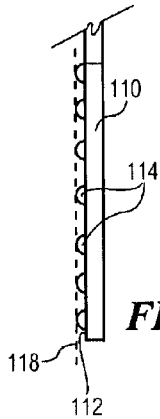
FIG. 8 is a side view of the journal engagement portion of FIG. 7.

FIG. 7 is a plan view of the journal engagement portion 106 and indicating relative disposition of the plurality of applicator abutments 114 on the mount abutment surface 112. FIG. 8 is a side view of the journal engagement portion 106 showing the plurality of applicator abutments 114 being substantially aligned to provide an abutment plane 118.

The mount abutment surfaces of the loops 108,110 only contact the plurality of applicator abutments 114 that provides the abutment plane 118. Thus, frictional resistance between the mount holders at both ends 18*a*, 18*b* of the paint applicator 12 and the loops 108,110 is reduced. Consequently, rotation of the paint applicator 12 when held by the applicator holder 94 is easier compared with existing container-type paint rollers.

In the alternate embodiment as shown in FIG. 5, FIG. 7 and FIG. 8, each of the plurality of applicator abutments 114 is hemispherical. However, as with the preferred embodiment, other shapes of the applicator abutments 114 are also possible to reduce contact areas with the base surface 82 of each of the two holder mounts. For example, each of the plurality of applicator abutments 114 can have a flat surface that, collectively, are substantially aligned along the flat surface relative to each other to thereby provide the abutment plane 118. The plurality of applicator abutments 114 therefore reduces contact with the base surface of each of the two holder mounts and thereby reduces contact frictional resistance thereat.

The present invention therefore provides the paint roller 10 having a paint applicator 12 and two holder mounts that are respectively associated with two opposite ends 18*a*, 18*b* of the paint applicator 12, and the applicator holders 14,94 for the paint roller 10 to overcome, or at least alleviate, the problems of the prior art.

While the present invention has been described in detail for the above embodiments with reference to FIGS. 1 to 8, it should be understood that FIGS. 1 to 8 are illustrative of the embodiments without limiting the invention. Accordingly, persons skilled in the art can make various modifications and improvements without departing from the spirit and the scope of the present invention.

What is claimed is:

1. A paint roller comprising:

a paint applicator having a cylindrical outer surface and two opposite ends; and two holder mounts, respectively associated with said two opposite ends, each of said holder mounts having:

a base surface;

a journal, protruding from said base surface in a direction away from said paint applicator; and a plurality of holder abutments, protruding from said base surface in said direction.

2. The paint roller as claimed in claim 1, wherein said plurality of holder abutments is substantially aligned to provide an abutment plane.

3. The paint roller as claimed in claim 1, wherein said journal comprises a cylindrical protrusion.

4. The paint roller as claimed in claim 3, wherein said plurality of holder abutments surrounds said cylindrical protrusion.

5. The paint roller as claimed in claim 3, wherein said cylindrical protrusion of at least one of said journal forms a channel, said cylindrical protrusion having an internal wall with at least one channel ridge formed thereat.

6. The paint roller as claimed in claim 5, and further comprising a cover having a wall engagement portion for engaging said internal wall.

7. The paint roller as claimed in claim 6, wherein said wall engagement portion comprises at least one cover ridge for coacting with said at least one channel ridge.

8. The paint roller as claimed in claim 1, and further comprising an applicator holder having:

a handle; and a fork having opposite sides, each of said opposite sides having a journal engagement portion.

9. The paint roller as claimed in claim 8, wherein said journal engagement portion comprises a loop for coupling to said journal.

10. The paint roller as claimed in claim 9, wherein said loop comprises a mount abutment surface for abutting said plurality of holder abutments.

11. A paint roller comprising:

a paint applicator having a cylindrical outer surface and two opposite ends;

two holder mounts, respectively associated with said two opposite ends, each of said holder mounts having:

a base surface;

and a journal, protruding from said base surface in a direction away from said paint applicator;

and an applicator holder having:

a handle;

and a fork having opposite sides, each of said opposite sides having:

a journal engagement portion;

and a plurality of applicator abutments, protruding from a surface of said journal engagement portion in a direction towards said paint applicator.

12. The paint roller as claimed in claim 11, wherein said plurality of holder abutments is substantially aligned to provide an abutment plane.

13. The paint roller as claimed in claim 11, wherein said journal further comprises a cylindrical protrusion.

14. The paint roller as claimed in claim 13, wherein said plurality of holder abutments surrounds said cylindrical protrusion.

15. The paint roller as claimed in claim 13, wherein said cylindrical protrusion of at least one of said journal forms a channel, said cylindrical protrusion having an internal wall with at least one channel ridge formed thereat.

16. The paint roller as claimed in claim 15, and further comprising a cover having a wall engagement portion for engaging said internal wall.

17. The paint roller as claimed in claim 16, wherein said wall engagement portion comprises at least one cover ridge for coacting with said at least one channel ridge.

18. The paint roller as claimed in claim 11, wherein said journal engagement portion comprises a loop for coupling to said journal.

19. An applicator holder for a paint roller with at least one journal, said applicator holder comprising:

a handle;

and a fork having opposite sides, each of said opposite sides having:

a journal engagement portion;

and a plurality of applicator abutments, protruding from a surface of said journal engagement portion in a direction towards said at least one journal.

20. The paint roller as claimed in claim 19, wherein said journal engagement portion comprises a loop for coupling to said at least one journal.

* * * * *

UNITED STATES PATENT AND TRADEMARK OFFICE

CERTIFICATE OF CORRECTION

PATENT NO. : 6,922,866 B2
DATED : August 2, 2005
INVENTOR(S) : Poh Leong Er

It is certified that error appears in the above-identified patent and that said Letters Patent is hereby corrected as shown below:

Title page,
Insert Item -- [63] Related U.S. Application Data
Continuation-in-part of application No. 10/040,652, filed 10/19/2001. --.

Column 1,
Line 2, insert -- Continuation-in-part of application No. 10/040,652, filed 10/19/2001. --.

Signed and Sealed this

Eighth Day of November, 2005

JON W. DUDAS
*Director of the United States Patent and Trademark Office*